US007462797B2

(12) United States Patent
Wong et al.

(10) Patent No.: US 7,462,797 B2
(45) Date of Patent: Dec. 9, 2008

(54) ELECTRICAL ROTARY SWITCH

(76) Inventors: Memie Mei Mei Wong, 7th Floor, Block 2, Leader Industrial Centre, 188-202 Texaco Road, Tsuen Wan, New Territories (HK); Sam Yun Sum Wong, 7th Floor, Block 2, Leader Industrial Centre, 188-202 Texaco Road, Tsuen Wan, New Territories (HK)

( * ) Notice: Subject to any disclaimer, the term of this patent is extended or adjusted under 35 U.S.C. 154(b) by 0 days.

(21) Appl. No.: 11/390,455

(22) Filed: Mar. 28, 2006

(65) Prior Publication Data

US 2007/0235314 A1 Oct. 11, 2007

(51) Int. Cl.
*H01H 19/20* (2006.01)

(52) U.S. Cl. ..... 200/571; 200/564

(58) Field of Classification Search ..... 200/526–531, 200/537, 560, 562–572, 316, 11 R, 336
See application file for complete search history.

(56) References Cited

U.S. PATENT DOCUMENTS 2,813,158 A * 11/1957 Hutt ..... 200/6 BB
4,280,028 A * 7/1981 Hollenbeck, Jr. ..... 200/43.11
4,816,623 A * 3/1989 Huang ..... 200/11 R
4,996,401 A * 2/1991 Park ..... 200/527
5,049,709 A * 9/1991 Prickett et al. ..... 200/527
5,343,004 A * 8/1994 Chen ..... 200/11 R
5,595,290 A * 1/1997 Hsieh ..... 200/571
5,669,489 A * 9/1997 von Ende ..... 200/570
5,743,387 A * 4/1998 Hung ..... 200/571
5,901,835 A * 5/1999 Hung ..... 200/316
6,051,801 A * 4/2000 Wang ..... 200/571
6,236,007 B1 * 5/2001 Ho ..... 200/564
6,809,281 B2 * 10/2004 Miki ..... 200/529
2007/0175742 A1 8/2007 Wong et al.

* cited by examiner

*Primary Examiner*—Elvin Enad
*Assistant Examiner*—Marina Fishman
(74) *Attorney, Agent, or Firm*—Leydig, Voit & Mayer, Ltd

(57) ABSTRACT

An electrical rotary switch has a casing, a rotor supported within the casing for rotation, a moving contact mounted on the rotor for rotation with the rotor, and four fixed contacts located laterally of the rotor for short-circuiting by the moving contact. Each fixed contact has a contact body in the casing for contact by the moving contact and a leg extending from the contact body and projecting out of the casing for insertion through a circuit board and soldering to the circuit board for mechanical and electrical connection.

12 Claims, 6 Drawing Sheets

ELECTRICAL ROTARY SWITCH

The present invention relates to an electrical rotary switch for controlling an electrical appliance.

BACKGROUND OF THE INVENTION

An electrical switch of the type concerned has a casing, a rotor therein, a moving contact mounted on the rotor for turning therewith, and a plurality of fixed contacts in the casing for short-circuiting by the moving contact to switch on an electrical appliance. The casing typically has a pair of side extensions with holes to enable use of screws or bolts to fix the switch at a desired location. Electric cables are usually used to connect the switch, by its fixed contacts, to the relevant electrical circuit. This has been the traditional way of fixing and connecting an electrical switch of the type concerned for many years.

The invention seeks to provide a new or otherwise improved electrical rotary switch that can relatively more easily be located and connected for use.

SUMMARY OF THE INVENTION

According to the invention, there is provided an electrical rotary switch comprising a casing, a rotor supported within the casing for rotation about an axis of rotation, a moving contact mounted on the rotor for rotation therewith, and a plurality of fixed contacts located laterally of the rotor for short-circuiting by the moving contact. At least one of the fixed contacts has a contact body in the casing for contact by the moving contact and a leg extending from the contact body and projecting out of the casing for insertion through a circuit board and soldering therewith for mechanical and electrical connection.

Preferably, the leg extends substantially perpendicular to the contact body.

More preferably, the contact body has a first end for contact with or by the moving contact and a second end connected with the leg.

It is preferred that the contact body is bent about a plurality of axes substantially parallel to the leg.

It is preferred that the casing comprises an upper part and a lower part connected together and holding the contact body captive between them.

It is further preferred that the leg extends through the lower part of the casing.

In a preferred embodiment, the contact body and the leg are two distinct members in contact with each other.

More preferably, the contact body and the leg comprise respective conductive strips that are relatively thicker and thinner respectively.

More preferably, the contact body is bent about a plurality of axes substantially parallel to the leg.

Further more preferably, the contact body has a first end for contact with or by the moving contact and a second end resiliently bearing against the leg.

Yet further more preferably, the leg has an upper end against which the second end of the contact body resiliently bears and a lower end projecting out of the casing, wherein the casing comprises an upper part and a lower part connected together and holding the contact body and the upper end of the leg captive between them.

Yet further more preferably, the upper end of the leg is folded and engaged by the upper part of the casing.

It is preferred that the casing is of a substantially flat square shape, having four corners each housing one respective said fixed contact.

In a preferred embodiment, the rotor has a side radially extending about the axis of rotation and a rotor periphery having a undulating profile surrounding the axis of rotation, resiliently against which rotor periphery the fixed contacts bear for sliding contact with the moving contact so as to be short-circuited thereby, and wherein the moving contact comprises a base at the rotor side and a plurality of parts adjacent the rotor periphery for contact by the fixed contacts, the parts being integrally connected to the base and folded therefrom to extend substantially parallel to the axis of rotation, at least one of the parts having an undulating profile matching with that of an adjacent part of the rotor periphery.

More preferably, the undulating profile of the rotor periphery comprises alternating crests and valleys, and the undulating profile of said at least one part of the moving contact extends continuously over at least two adjacent said valleys.

More preferably, the undulating profile of the rotor periphery comprises alternating crests and valleys, and the undulating profile of said at least one part of the moving contact comprises at least two adjacent valleys matching with that of the rotor periphery.

More preferably, the moving contact fits over the rotor, with its base lying on the rotor side and its periphery meeting the rotor periphery.

More preferably, the moving contact is produced by way of a deep-draw manufacturing process from a blank of material.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
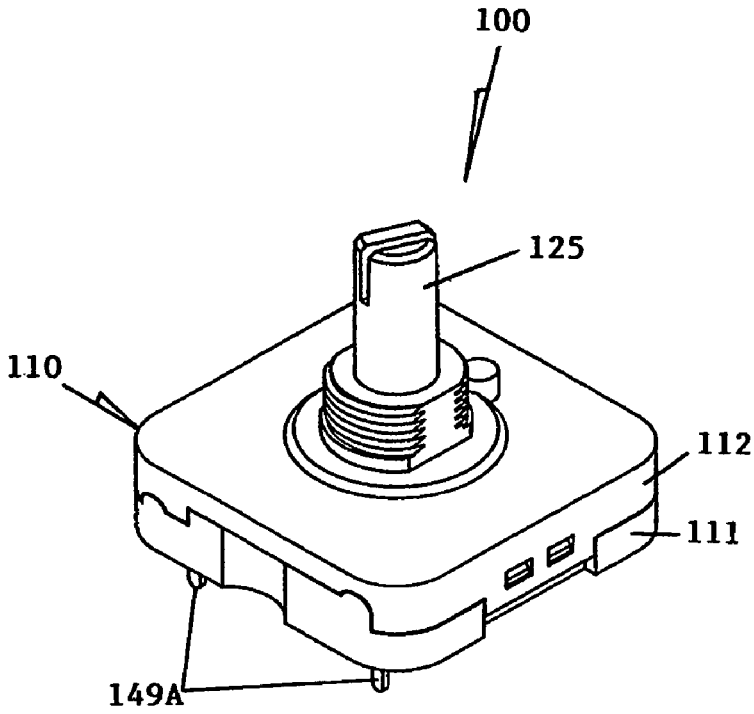
FIG. 1 is a top perspective view of an embodiment of an electrical rotary switch in accordance with the invention.
Figure 2:
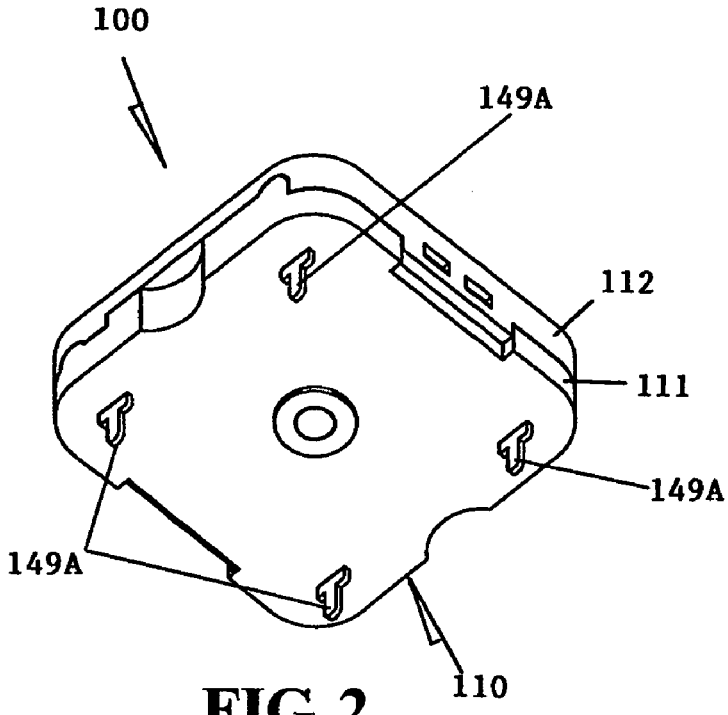
FIG. 2 is a bottom perspective view of the rotary switch of FIG. 1.
Figure 3:
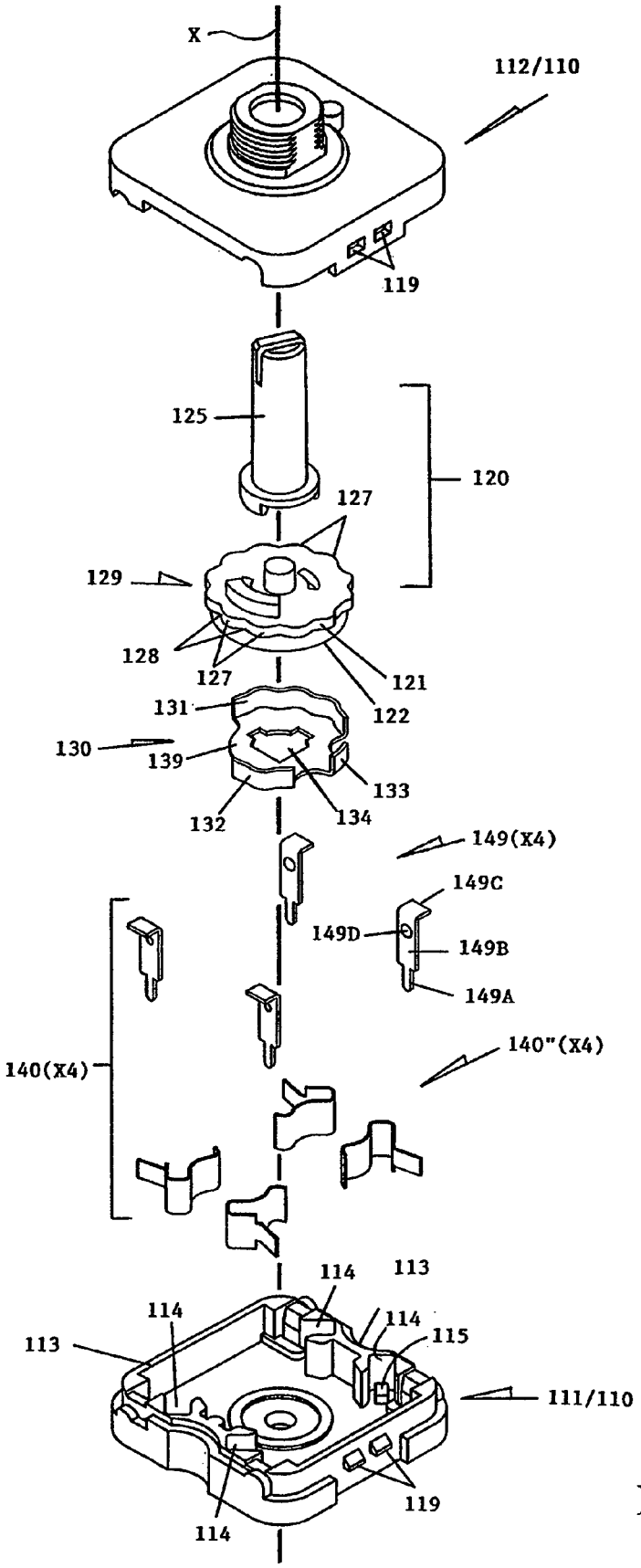
FIG. 3 is an exploded top perspective view of the rotary switch of FIG. 1, showing all its components.
Figure 4:
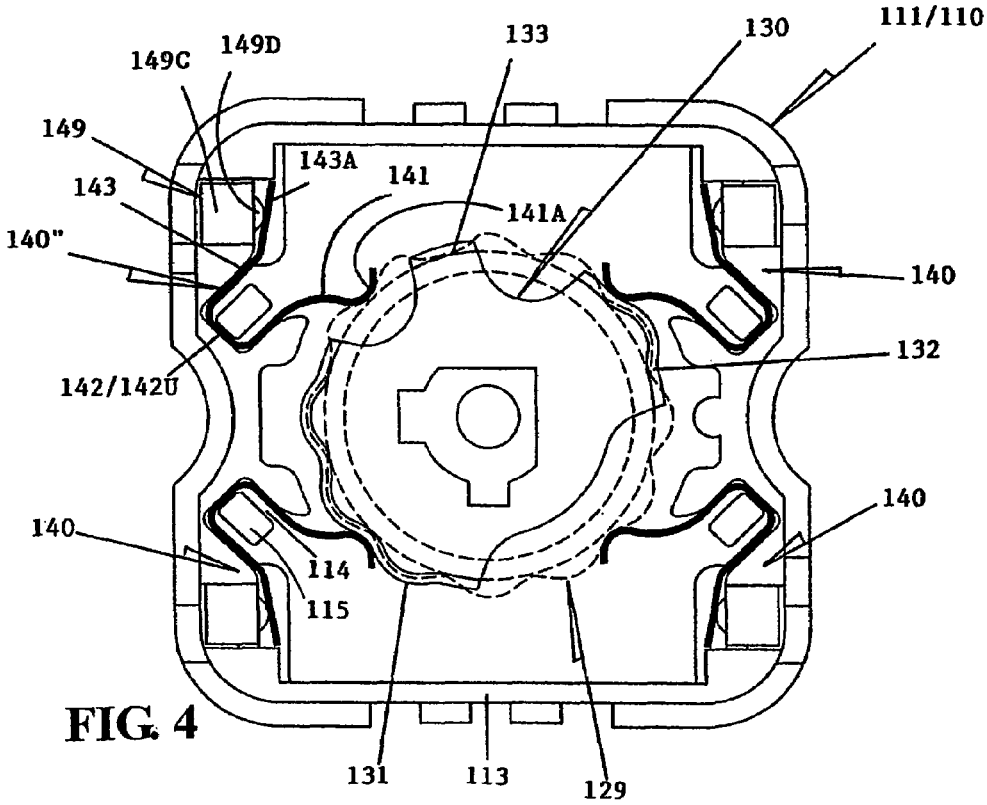
FIG. 4 is a top plan view showing certain parts of the rotary switch of FIG. 3.
Figure 5:
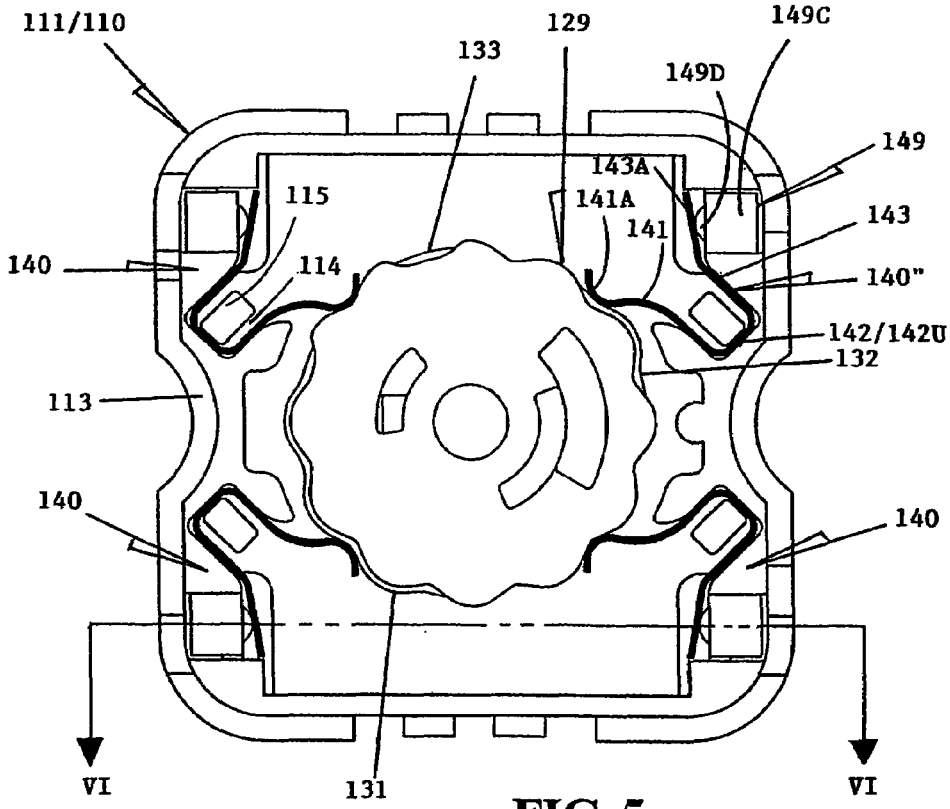
FIG. 5 is another top plan view similar to FIG. 4.

Referring to the drawings, there is shown an electrical rotary switch 100 embodying the invention, which has a generally flat square casing 110, a rotor 120, a moving contact 130 mounted on the rotor 120 and four fixed contacts 140 located generally within respective corners of the casing 110 surrounding the rotor 120. The casing 110 (shown in a horizontal position) is formed by a flat square base 111 and a matching lid 112 closing upon an open upper side of the base 111.

The rotor 120 has a generally circular disc-like body 129 located centrally inside the casing 110 for rotation about a central axis of rotation X (vertical as shown) over 360° in opposite directions. The rotor 120 includes a central shaft 125 which projects upwardly from the rotor body 129 out of the casing 110 through the lid 112 along the axis X to enable manual turning of the rotor 120. A turning knob (not shown) is usually fitted to the shaft 125 to facilitate turning.

The rotor body 129 has a peripheral flange 121 surrounding the axis X and a flat open lower end 122 having an end side or surface radially extending with respect to the axis X. The flange 121 has an undulating or wavy profile formed by a ring of twelve evenly-spaced arcuate crests 127, with a flat V-shaped valley 128 between adjacent crests 127. The twelve valleys 128 are situated at, say, $1^{st}$ to $12^{th}$ angular position about the axis X. The fixed contacts 140 bear resiliently against the valleys 128 to define twelve stable angular positions for the rotor 120 and to slidingly make/break contact with/from the moving contact 130.

The moving contact 130 has a generally flat horizontal main body or base 139 and three integral rim parts or tabs 131, 132 and 133 upstanding therefrom at the $1^{st}$ to $4^{th}$, the $8^{th}$ and $9^{th}$ and the $11^{th}$ valley positions respectively. The moving contact 130 fits from below over the lower end 122 of the rotor body 129, with its base 139 underlying the lower end surface and its tabs 131 to 133 lying around the side and meeting the rotor's peripheral flange 121. An axial projection at the rotor's lower end 122 fitting through a central aperture 134 of the base 139 is expanded by heat to secure the moving contact 130 to the rotor 120.

The first contact tab 131 is the widest and extends continuously over the $1^{st}$ to $4^{th}$ valley positions, having a wavy profile matching with that of the adjacent portion of the rotor's flange 121 but slightly radially expanded therefrom for contact with or by the fixed contacts 140. The second contact tab 132 spans continuously over the $8^{th}$ and $9^{th}$ valley positions, also having a wavy profile matching with that of the adjacent portion of the rotor's flange 121 but slightly radially expanded therefrom for contact with or by the fixed contacts 140. The third contact tab 133 is the narrowest and is generally flat (slightly curved) as shown, or it may be slightly V-shaped, to guard the corresponding valley 128 at the $11^{th}$ position likewise for contact with or by the fixed contacts 140.

In general, the moving contact 130 is mounted fast on the rotor 120 for rotation therewith, with its base 139 and contact tabs 131 to 133 enclosing the rotor's lower end 122 and the contact tabs 131 to 133 slightly radially protruding beyond the rotor's flange 121 for contact with or by the fixed contacts 140.

The moving contact 130 is produced by way of a deep-draw manufacturing process which involves the use of a plug 201 and a die 202, as illustrated in FIGS. 7A to 7D. The plug 201 has a uniform cross-section which corresponds to the inner cross-section of the moving contact 130 as defined in part by the inner surfaces of the wavy-profiled contact tabs 131 and 132 and the flat contact tab 133. The die 202 has a central through bore or cavity 203 which has a cross-section corresponding to the outer cross-section of the moving contact 130 as defined in part by the outer surfaces of the wavy-profiled contact tabs 131 and 132 and the flat contact tab 133. The cross-section remain constant at the top end of the cavity 203 over a relatively short distance greater than the thickness of the moving contact 130, and then widens gradually downwards.

Production of the moving contact 130 starts with a blank 130D of metal material such as copper alloy, which is initially stamped out from a much larger base sheet to a shape corresponding to the flat development of the moving contact 130. The blank 130D includes three peripheral protrusions corresponding to the contact tabs 131 to 133 laid flat.

Figure 7A:
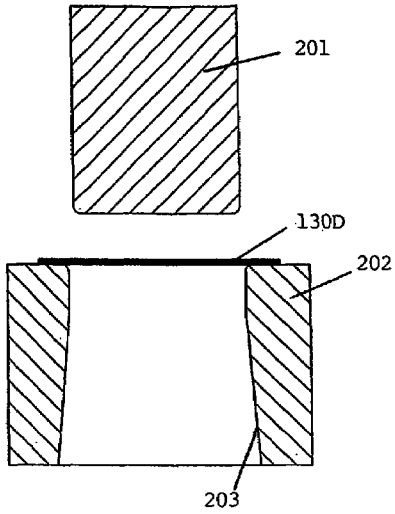
FIGS. 7A to 7D are cross-sectional side views that illustrate the process of making a moving contact of the rotary switch of FIG. 3.
Figure 7B:
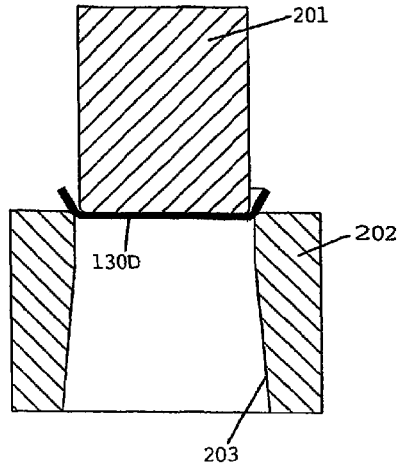
Figure 7C:
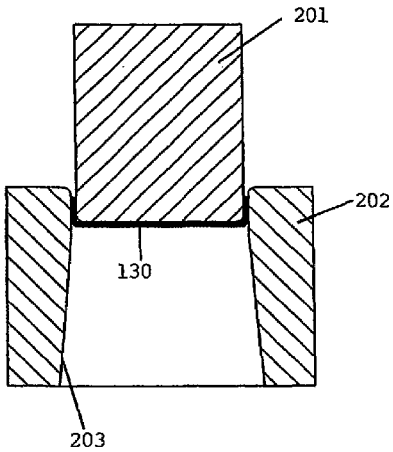

To commence the deep-draw process, the blank 130D is initially placed on the upper end of the die 202, or upon the lower end of the plug 201, at the right position aligned with the plug 201 or as determined by reference to its central aperture 134 (FIG. 7A). Upon pressing down of the plug 201 into the cavity 203 of the die 202, the blank 130D is folded with its peripheral protrusions about the edge of the lower end of the plug 201 through 90° until the protrusions turn vertically upright to form the contact tabs 131 to 133 (FIGS. 7B to 7C), whereupon the moving contact 130 is created.

Figure 7D:
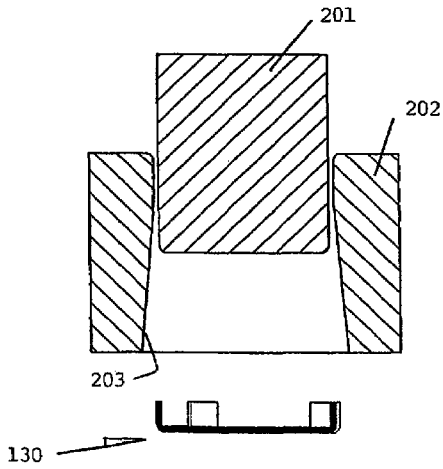

As the protrusions corresponding to the first and second contact tabs 131 and 132 are being folded, they are simultaneously stretched to acquire their wavy profiles as mentioned above. Pressing of the plug 201 deeper to reach the wider part of the cavity 203 allows release of the contact 130 from the plug 201 (FIG. 7D).

Figure 8A:
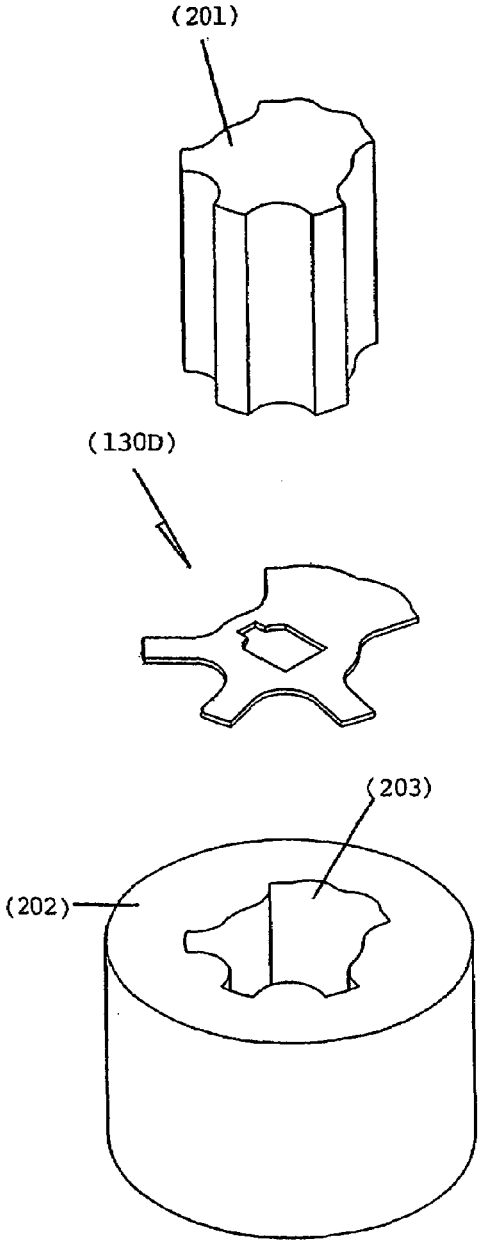
FIGS. 8A and 8B are perspective views showing a setup similar to that of FIGS. 7A to 7D.
Figure 8B:
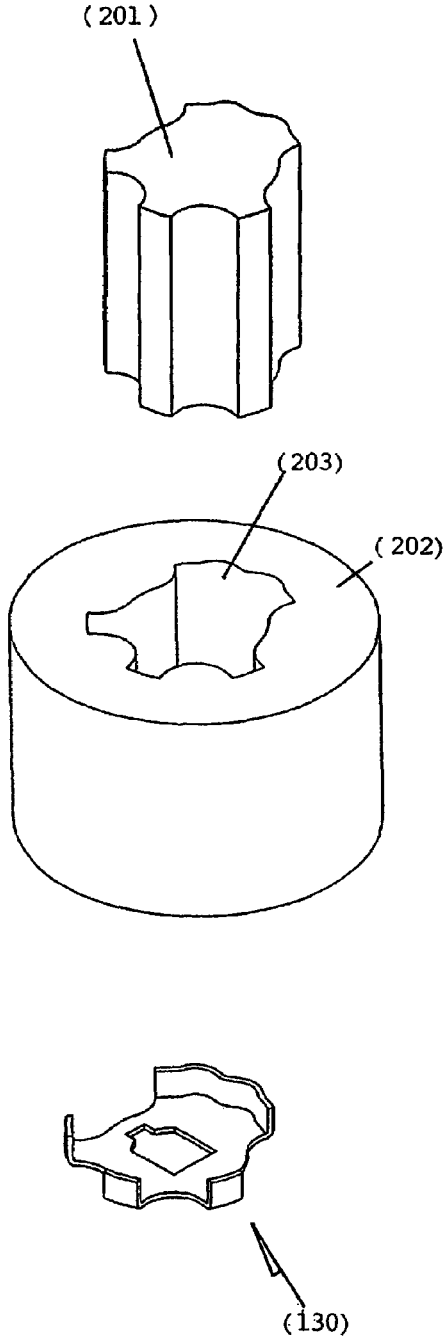

A similar plug (201) and die (202) are shown in FIGS. 8A and 8B for illustration purposes only, which are used to make a similar moving contact (130) whose contact tabs are different in terms of position and width.

The four fixed contacts 140 are located generally within respective corners of the casing 110, laterally around the rotor 120 and moving contact 130 for short-circuiting by the moving contact 130, whereby the switch 100 is closed. The fixed contacts 140 have identical construction and are interchangeable for ease of production and assembly.

Each fixed contact 140 is formed by two separate/distinct members in contact with each other, namely a contact body 140" which is located horizontally in the casing 110 for contact by the moving contact 130 and a vertical leg 149 which extends downwardly from the contact body 140", at right angles thereto, and projects out of the casing 110 through its base 111 for external connection.

The contact body 140" has a generally U-shaped configuration, being formed by a copper (or copper alloy) strip that is bent through an angle of about 90° twice, about two vertical axes, into a series of first, second and third integrally connected sections 141, 142 and 143, taken in a direction outwardly from the axis X. From the second section 142, the first section 141 is curved smoothly outwardly and then inwardly into a spoon-like end 141A which bears resiliently against the rotor's peripheral flange 121 for sliding contact with or by any one of the moving contact tabs 131 to 133. The first section 141 is sufficiently long and is shaped as described to achieve an optimum resilience and contact pressure upon the moving contact 130.

The second section 142 is short and flat and interconnects the first and third sections 141 and 143 via respective curved bends each of an angle substantially 90°, together forming a generally rectangular U-shaped bend 142U. The third section 143 is folded at about mid-length outwardly through an angle of about 35° to yield an inclined flat end 143A for connecting or contacting the leg 149.

The leg 149 is made from another copper strip, having a lower flat pin 149A and an upper butt 149B that is wider than the pin 149A. The butt 149B has a top end 149C that is folded through an angle of 90° to stick out horizontally on one side and includes a flat lump 149D on the vertical surface on the opposite side for contacting the contact body 140".

Turning to the casing 110 or the base 111 thereof, its side wall 113 extends along the complete periphery without any openings and defines four corners each having a rectangular bay 114. The bay 114 is oriented at an angle of about 45° as shown and is shaped to match the outer shape of the bend 142U of the associated fixed contact body 140" for locating the same in position. A rectangular knob 115 on a bottom wall 116 of the base 111 in the bay 114 fixes the contact body 140" by holding its second section 142 against the side wall 113.

Put differently, the knob 115 defines a narrow gap with the side wall 113 into which the second section 142 is press fitted, whereby the bend 142U is held in the bay 114, bearing with its outer surface against the side wall 113. The first and third sections 141 and 143 on opposite sides of the bend 142U are slightly deflectable inwardly. The first section 141 is exposed to resiliently bear against the rotor body 129 and moving contact 130 for contact making/breaking.

Figure 6:
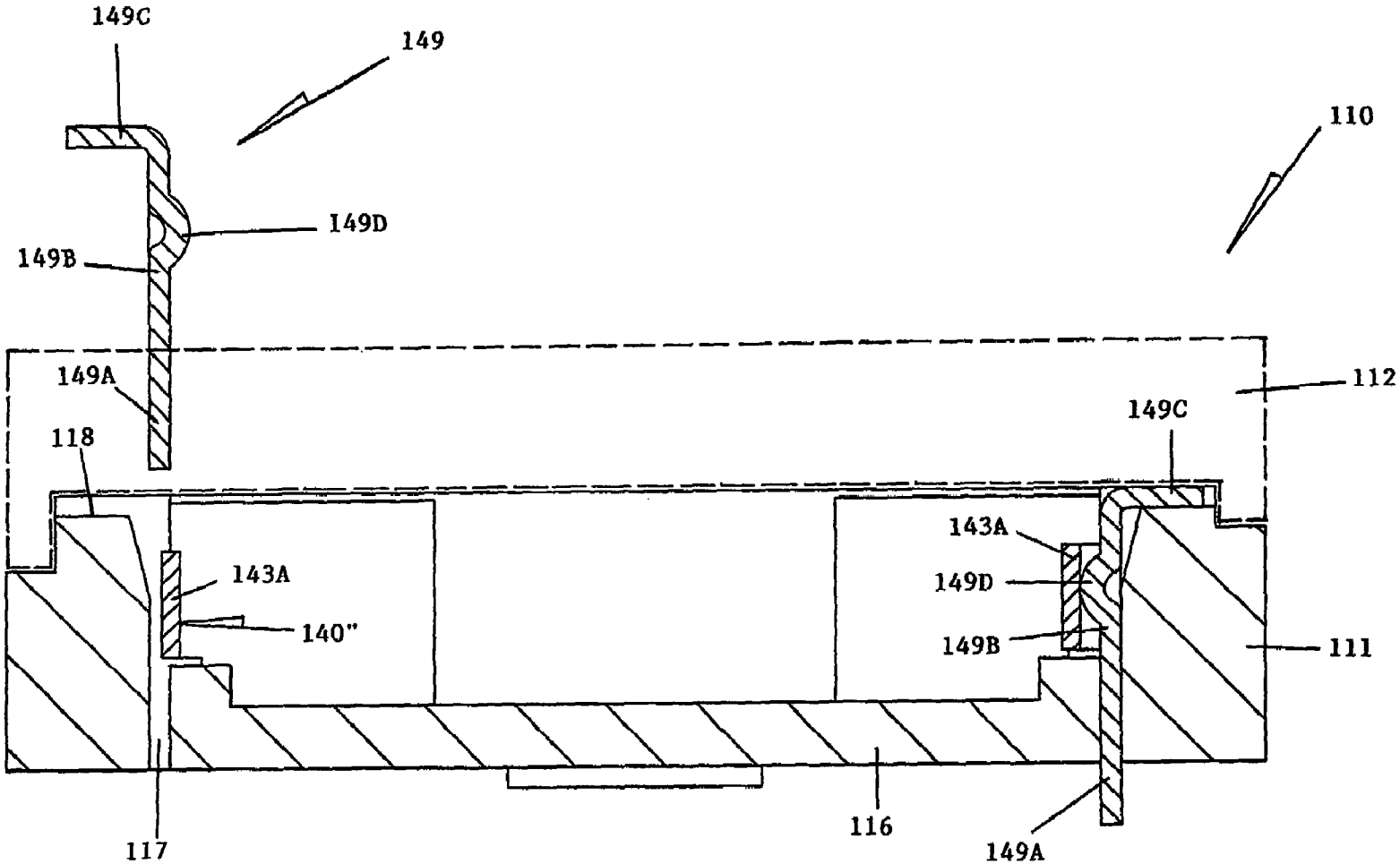
FIG. 6 is a schematic cross-sectional side view of the switch parts of FIG. 5, taken along line VI-VI.

Referring specifically to FIG. 6, after the contact body 140" has been fitted in the right place in the casing base 111, the leg 149 is inserted downwardly into the base 111 at a position adjacent the end 143A of the contact body 140", with its pin 149A passing through a small slot 117 in the bottom wall 116. The leg 149 descends until its folded top end 149C engages upon a plateau 118 on the base 111. During insertion of the leg 149, the end 143A of the contact body 140" is displaced sideways by the leg 149 to thereby eventually bear resiliently against the butt 149B by its lump 149D, whereupon the contact body 140" and the leg 149 are properly located and connected together to form the complete fixed contact 140.

The rotor 120 with the moving contact 130 mounted thereunder is installed into the casing base 111 after all the four fixed contacts 140 have been fitted in place. The lid 112 is finally closed upon the base 111 and secured therewith by snap connections 119, thereby holding the contact body 140" and the leg's butt 149B captive between them. The lid 112 is shaped on the underside of its four corners to engage upon the contact body 140" and the leg 149 by its folded top end 149C, thereby holding them in position.

Considering all the four fixed contacts 140, their pins 149A are arranged to project out from the bottom of the switch casing 110 as switch terminals at the four corners of an imaginary square which fits the arrangement of the holes of a standard circuit board for mounting electronic components. The pins 149A have a cross-section that is slightly smaller than that of the circuit board holes such that they can be inserted through the appropriate holes and then soldered with the relevant conducting tracks/pads on the other side of the circuit board for both mechanical and electrical connection.

The design of the fixed contacts 140 or in particular the switch terminals 149A makes it possible for the subject rotary switch 100 to be simultaneously mounted and connected on a circuit board in the same manner as most electronic components. This way of fixing and connecting the switch 100 is easy and convenient as it eliminates the traditional use of screws for fixing and cables/wires for connection, taking advantage of a circuit board that often exists in most if not all electrical appliance and is usually located behind a control panel where the switch 100 is most likely needed.

The contact bodies 140" are made from conductive strips that are relatively thinner for flexibility compared with the conductive strips producing the legs 149, which are relatively thicker for rigidity. The strips may be of different materials or compositions to achieve the desired properties e.g. resilience and solderability.

The invention has been given by way of example only, and various modifications of and/or alterations to the described embodiment may be made by persons skilled in the art without departing from the scope of the invention as specified in the appended claims.

What is claimed is:

1. An electrical rotary switch comprising:

a casing including an upper part and a lower part connected together;

a rotor including a rotor body supported within the casing for rotation about an axis of rotation;

a moving contact mounted on the rotor body and located within the casing for rotation with the rotor; and a plurality of fixed contacts located within the casing, laterally of the rotor body, for selective short circuiting by the moving contact, wherein at least one of the fixed contacts has a contact body held captive in the casing, between the upper and lower parts of the casing, for contact by the moving contact, and a leg extending from the contact body and including a top end and a butt portion held captive in the casing, between the upper and lower parts of the casing, and a narrower pin portion projecting through the lower part of the casing and out of the casing for insertion through a hole in a circuit board and soldering to the circuit board for mechanical and electrical connection, the contact body and the leg are two distinct members in contact with each other at the butt portion of the leg, the contact body is bent about a plurality of axes substantially parallel to the butt portion of the leg, and the contact body has a first end for contacting the moving contact and a second end resiliently bearing against the butt portion of the leg.

2. The electrical rotary switch as claimed in claim 1, wherein the top end of the leg extends substantially perpendicular to the contact body.

3. The electrical rotary switch as claimed in claim 1, wherein the contact body and the leg comprise respective conductive strips, the contact body being thicker than the leg.

4. The electrical rotary switch as claimed in claim 1, wherein the top end of the leg is folded and engaged by the upper part of the casing.

5. The electrical rotary switch as claimed in claim 1, wherein the casing has a substantially flat square shape, having four corners, each corner housing one of the fixed contacts.

6. The electrical rotary switch as claimed in claim 1, wherein the rotor body has a side radially extending about the axis of rotation and a rotor periphery having a undulating profile surrounding the axis of rotation, the fixed contacts resiliently bearing against the rotor periphery for sliding contact with the moving contact, and short-circuiting by the moving contact, and the moving contact comprises a base at a rotor side and a plurality of parts adjacent the rotor periphery for contact by the fixed contacts, the parts being integrally connected to the base, folded from the base, and extending substantially parallel to the axis of rotation, at least one of the parts having an undulating profile matching the undulating profile of an adjacent part of the rotor periphery.

7. The electrical rotary switch as claimed in claim 6, wherein the moving contact fits over the rotor body, with the base of the moving contact on a rotor side, the base having a periphery meeting the rotor periphery.

8. The electrical rotary switch as claimed in claim 6, wherein the moving contact is produced by deep-drawing of a blank of material.

9. The electrical rotary switch as claimed in claim 6, wherein the undulating profile of the rotor periphery comprises alternating crests and valleys, and the undulating profile of the at least one part of the moving contact extends continuously over at least two of the valleys that are adjacent to each other.

10. The electrical rotary switch as claimed in claim 6, wherein the undulating profile of the rotor periphery comprises alternating crests and valleys, and the undulating profile of the at least one part of the moving contact comprises at least two adjacent valleys matching the undulating profile of the rotor periphery.

11. The electrical rotary switch as claimed in claim 1, wherein the second end of the contact body, resiliently bearing against the leg, bears resiliently along a direction transverse to the butt portion of the leg.

12. The electrical rotary switch as claimed in claim 1, wherein the rotor includes a shaft connected to the rotor body and projecting through the upper part of the casing and out of the casing, in a direction generally parallel to and opposite from a direction along which the pin portion of the leg projects through and out of the lower part of the casing.

* * * * *